US011837821B2

(12) United States Patent
Murakami et al.

(10) Patent No.: US 11,837,821 B2
(45) Date of Patent: Dec. 5, 2023

(54) CONNECTOR ASSEMBLY WITH LOCKING LEVER

(71) Applicant: Molex, LLC, Lisle, IL (US)

(72) Inventors: Kai Murakami, Yamato (JP); Kimiyasu Makino, Yamato (JP)

(73) Assignee: Molex, LLC, Lisle, IL (US)

( * ) Notice: Subject to any disclaimer, the term of this patent is extended or adjusted under 35 U.S.C. 154(b) by 20 days.

(21) Appl. No.: 17/506,669

(22) Filed: Oct. 21, 2021

(65) Prior Publication Data

US 2022/0131316 A1 Apr. 28, 2022

(30) Foreign Application Priority Data

Oct. 26, 2020 (JP) ..... 2020-178847

(51) Int. Cl.
*H01R 13/629* (2006.01)
*H01R 13/639* (2006.01)

(52) U.S. Cl.
CPC . *H01R 13/62955* (2013.01); *H01R 13/62938* (2013.01); *H01R 13/639* (2013.01)

(58) Field of Classification Search
CPC ..... H01R 13/62955; H01R 13/62938; H01R 13/639
See application file for complete search history.

(56) References Cited

U.S. PATENT DOCUMENTS 2,987,693 A * 6/1961 Wamsley ..... H01R 13/62933 439/157
5,174,785 A * 12/1992 Endo ..... H01R 12/724 439/372
5,230,635 A * 7/1993 Takenouchi ..... H01R 13/62938 439/153
5,401,179 A * 3/1995 Shinchi ..... H01R 13/62955 439/372
5,938,458 A * 8/1999 Krehbiel ..... H01R 13/62938 439/157
6,422,763 B1 * 7/2002 Halbach ..... G02B 6/3829 439/157
6,692,274 B2 * 2/2004 Maegawa ..... H01R 13/62933 439/157
7,201,591 B2 * 4/2007 Fujii ..... H01R 13/639 439/157
7,419,390 B2 * 9/2008 Ohtaka ..... H01R 13/62955 439/372
7,442,058 B2 * 10/2008 Ohtaka ..... H01R 13/6272 439/157
7,726,988 B2 * 6/2010 Martin ..... H01R 13/62944 439/157
7,785,131 B2 * 8/2010 Ferderer ..... H01R 13/62933 439/372
8,206,165 B2 6/2012 Mito
(Continued)

*Primary Examiner* — Neil Abrams

(57) ABSTRACT

A lock lever of a second connector has a first engaged part and a second engaged part. A frame of a first connector has a first engaging part and a second engaging part. The first engaging part is engaged with the first engaged part in a locked state where the lock lever is at a lock position. The lock lever has the elastic part that is elastically deformable in the horizontal direction. The elastic part has a second engaged part and is elastically deformed in the horizontal direction in the locked state to bring the second engaged part into contact with the second engaging part.

20 Claims, 13 Drawing Sheets

(56) References Cited

U.S. PATENT DOCUMENTS

| | | | | |
|---|---|---|---|---|
| 8,215,979 | B2 * | 7/2012 | Shamoto | H01R 13/62938 439/372 |
| 8,986,024 | B2 * | 3/2015 | Ikeda | H01R 13/62938 200/332 |
| 10,707,616 | B2 * | 7/2020 | Kosaka | H01R 13/62955 |
| 2003/0022538 | A1 * | 1/2003 | Langolf | H01R 13/6295 439/157 |
| 2022/0131316 | A1 * | 4/2022 | Murakami | H01R 12/88 |

* cited by examiner

CONNECTOR ASSEMBLY WITH LOCKING LEVER

RELATED APPLICATIONS

This application claims priority to Japanese Patent Application No. 2020-178847, filed Oct. 26, 2020, which is incorporated herein by reference in its entirety.

TECHNICAL FIELD

The present disclosure relates to a connector assembly having a lock lever that regulates the separation of two connectors.

BACKGROUND ART

In the connector assembly disclosed in Japanese Patent No. 5135173, one connector has a lever rotatable about an axis line extending in the horizontal direction. The lever has an engagement hook 71 at the front end thereof. The engagement hook 71 can be engaged with an engagement protrusion 73 formed in the other connector. The separation of the two connectors is prevented by the engagement of the engagement hook 71 and the engagement protrusion 73.

SUMMARY

It has been determined that when the relative positions of the two connectors in the direction along the axis line of the lever change due to the slight vibration of a device mounted with the connector, noise, instantaneous interruption, or the like may occur in a signal transmitted through the connector, and as a result, the reliability of the signal decreases. In particular, when the signal has a high frequency, such a problem becomes particularly problematic.

A connector assembly proposed in the present disclosure includes: a first connector including a plurality of terminals arranged in a first direction and a frame surrounding the plurality of terminals; and a second connector having a plurality of terminals arranged in the first direction, connected to the first connector in a second direction, and disposed inside the frame. The second connector includes a lock lever movable between a lock position at which the second connector is engaged with the frame and an unlock position at which the second connector is disengaged from the frame. The lock lever has a first engaged part and a second engaged part. The frame has a first engaging part and a second engaging part. In a locked state where the lock lever is at the lock position, the first engaging part engages with the first engaged part to regulate the separation of the first connector and the second connector in the second direction, one of the lock lever and the frame has an elastic part elastically deformable in the first direction. The elastic part has one of the second engaged part and the second engaging part and elastically deforms in the first direction in the locked state to bring the one into contact with the other of the second engaged part and the second engaging part.

In certain embodiments it is possible to prevent a change in the relative positions of the two connectors due to the slight vibration of a device mounted with the connector assembly.

BRIEF DESCRIPTION OF DRAWINGS

The present application is illustrated by way of example and not limited in the accompanying figures in which like reference numerals indicate similar elements and in which.

DETAILED DESCRIPTION

The detailed description that follows describes exemplary embodiments and the features disclosed are not intended to be limited to the expressly disclosed combination(s). Therefore, unless otherwise noted, features disclosed herein may be combined together to form additional combinations that were not otherwise shown for purposes of brevity.

Figure 1:
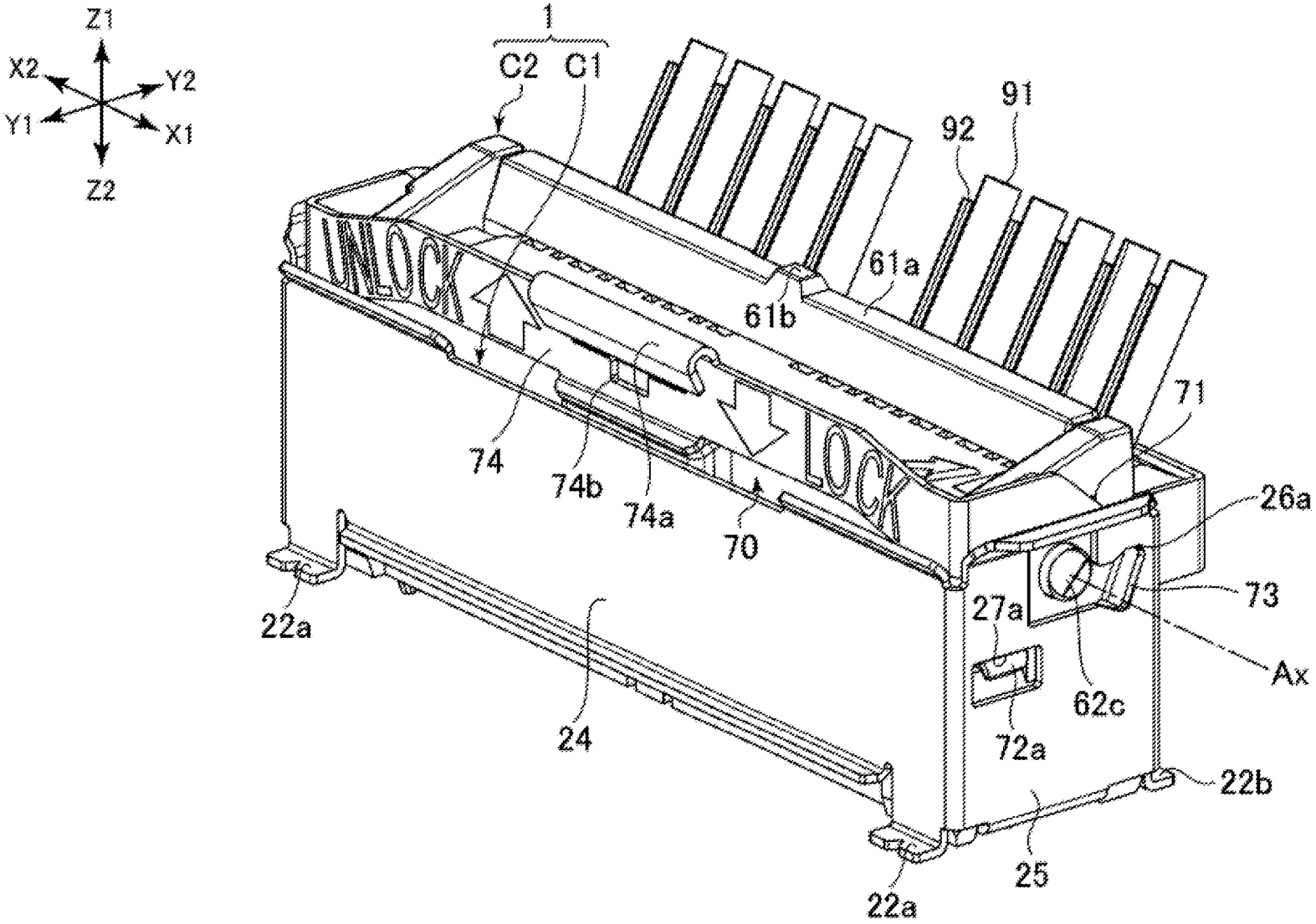
FIG. 1 is a perspective view illustrating an example of a connector assembly proposed in the present disclosure.

An example of a connector assembly proposed in the present disclosure will be described. Hereinafter, an X1 direction and an X2 direction illustrated in FIG. 1 are referred to as a right side and a left side, respectively, a Y1 direction and a Y2 direction illustrated in FIG. 1 are referred to as a front side and a rear side, respectively, and a Z1 direction and a Z2 direction illustrated in FIG. 1 are referred to as an upper side and a lower side, respectively. A direction of X1-X2 is referred to as a horizontal direction or "a direction along an axis line Ax" of a lock lever 70 described later. The horizontal direction is a direction in which terminals 11, 12, 51, 52 to be described later are arranged. These directions are used to describe the relative positional relationship of each portion of the connector and do not limit the posture of the connector when mounted on another device.

Figure 2:
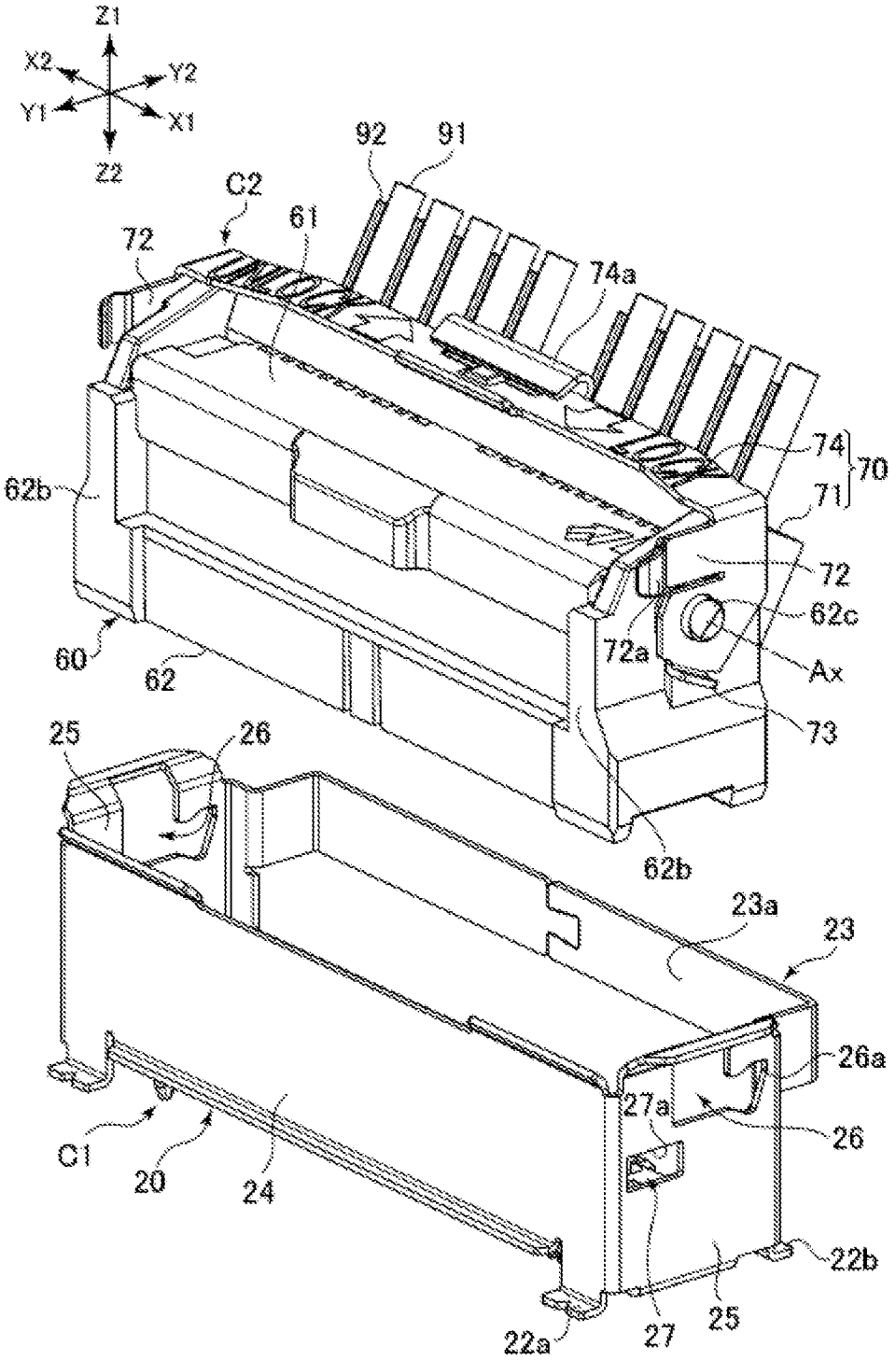
FIG. 2 is an exploded view of the connector assembly proposed in the present disclosure.
Figure 3:
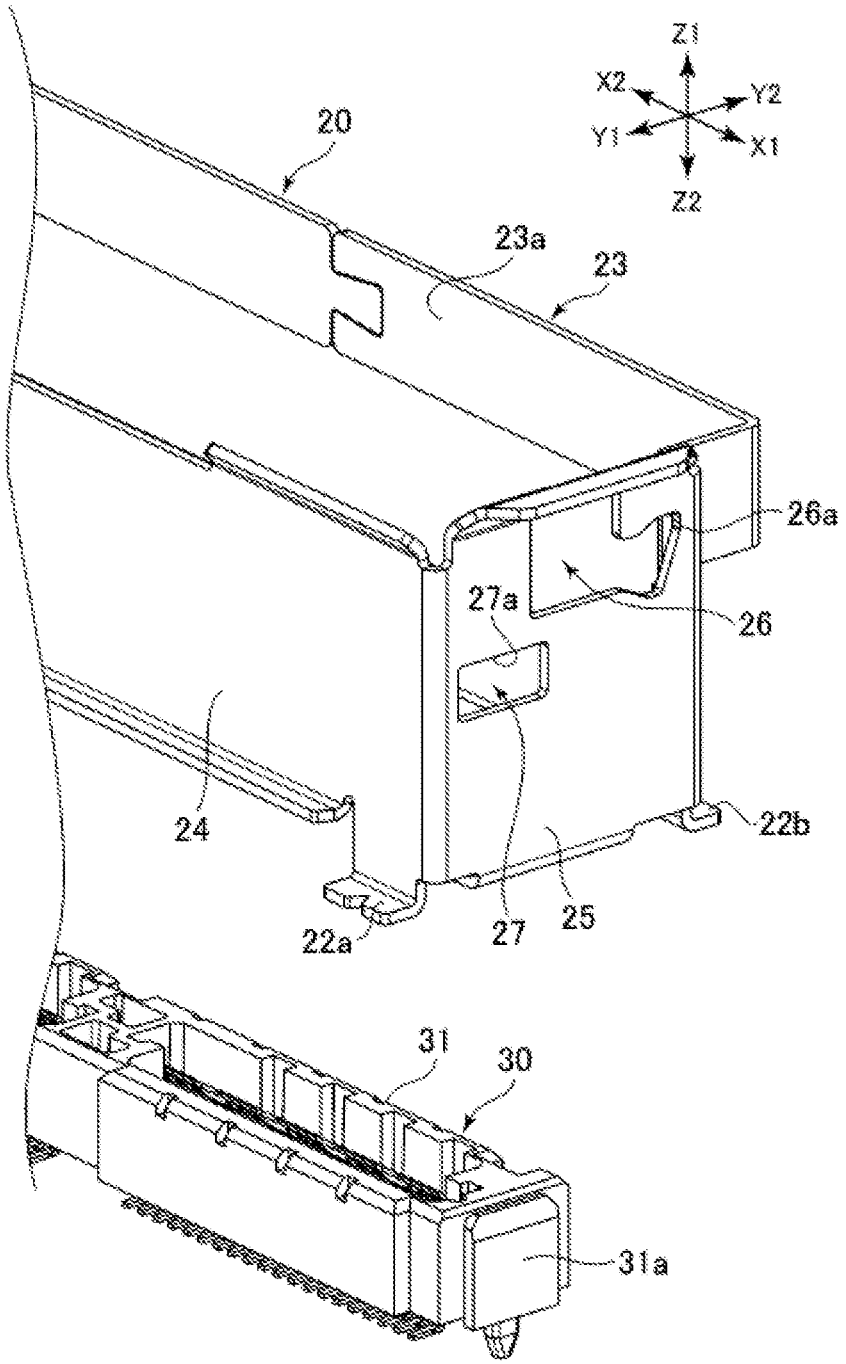
FIG. 3 is an exploded perspective view of a first connector constituting the connector assembly.

As illustrated in FIG. 2, a connector assembly 1 includes a first connector C1 and a second connector C2. The first connector C1 is, for example, a connector mounted on a circuit board (not illustrated). As illustrated in FIG. 3, the first connector C1 may include a plurality of terminals 11, 12 arranged in the horizontal direction, a frame 20 surrounding the terminals 11, 12, and a first housing 30 disposed inside the frame 20 and holding the terminals 11, 12. The first housing 30 may be attached to the frame 20 (cf. FIG. 4). The second connector C2 includes a plurality of terminals 51, 52 (cf. FIG. 6) arranged in the horizontal direction. The second connector C2 is, for example, a connector provided at the ends of the plurality of cables 91, 92. The terminals 51, 52 may be connected to the ends of the plurality of cables 91, 92, respectively. The second connector C2 may include a second housing 60 (cf. FIG. 2) holding the terminals 51, 52 and a lock lever 70 (cf. FIG. 2) attached to the second housing 60. Unlike the connector assembly 1, both the first connector C1 and the second connector C2 may be connectors provided at the ends of the cables.

The first connector C1 and the second connector C2 may be connectable and separable in the vertical direction. The frame 20 has a box shape opened upward. As illustrated in FIG. 1, when the first connector C1 and the second connector C2 are connected (that is, when the connectors C1, C2 are in a locked state to be described later), the second connector C2 is disposed inside the frame 20 of the first connector C1. A change in the relative position of the second connector C2 with respect to the first connector C1 is restricted by the frame 20. For example, the inclination of the second connector C2 forward (or rearward) with respect to the first housing 30 of the first connector C1 is restricted by the frame 20. The function of the frame 20 will be described in detail later.

Figure 6:
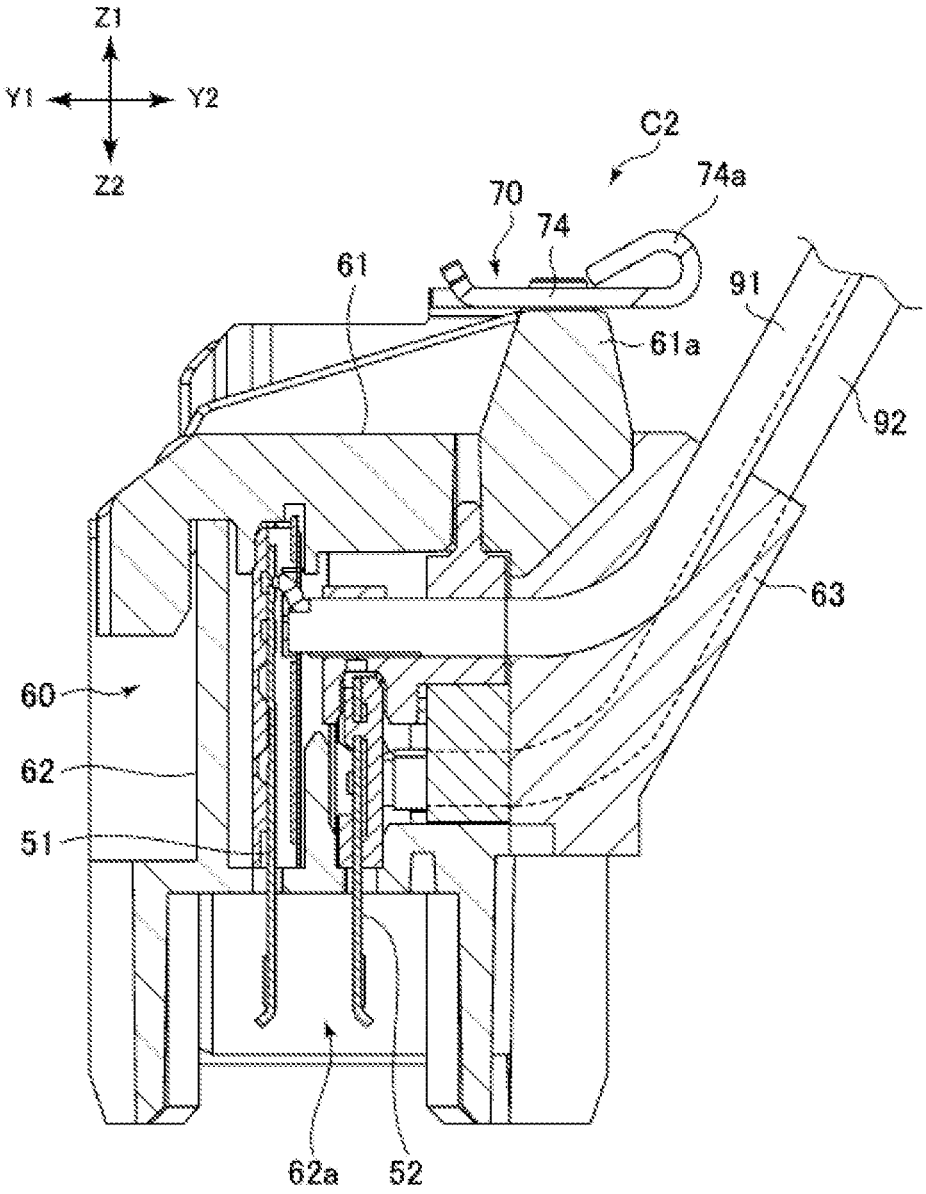
FIG. 6 is a cross-sectional view of a second connector taken along line VI-VI illustrated in FIG. 5.

As illustrated in FIG. 6, the second connector C2 may include a plurality of front terminals 51 arranged in the horizontal direction and a plurality of rear terminals 52 arranged in the horizontal direction. The front terminal 51 is connected to the end of the cable 91 and may extend downward from the end of the cable 91. The rear terminal 52 is connected to the end of the cable 92 and may extend downward from the end of the cable 92. The cable 91 may extend rearward from the upper part of the front terminal 51. The cable 91 may bend rearward and upward and extend obliquely rearward and upward from the rear side of the second connector C2. Similarly to the cable 91, the cable 92 may extend rearward from the upper part of the rear terminal 52. The cable 92 may bend rearward and upward and extend obliquely rearward and upward from the rear side of the second connector C2.

Since the cables 91, 92 extend obliquely upward from the second connector C2 as thus described, when a plurality of connector assemblies 1 are arranged in the front-rear direction and mounted on the circuit board, an interval between the adjacent connector assemblies 1 can be reduced. That is, the arrangement density of the plurality of connector assemblies 1 can be increased. In addition, with a space being ensured above the second connector C2, the movable range of the lock lever 70 to be described later can be increased using the space.

As illustrated in FIG. 6, the second housing 60 accommodates connection portions between the terminals 51, 52 and the cables 91, 92 (the upper parts of the terminals 51, 52). The second housing 60 has a fitting recess 62*a* in the lower part. The fitting recess 62*a* opens downward. In a state where the first connector C1 and the second connector C2 are connected, the first housing 30 is fitted inside the fitting recess 62*a* (cf. FIG. 10B). The lower parts of the terminals 51, 52 are exposed inside the fitting recesses 62*a* and are in contact with terminals 11, 12 to be described later in the first connector C1, respectively.

As illustrated in FIG. 6, the second housing 60 may have a housing upper part 61 that constitutes the upper part of the second housing 60 and covers the upper sides of the terminals 51, 52, and a housing lower part 62 that constitutes a lower part of the second housing 60 and has the fitting recess 62*a*. In addition, the second housing 60 may have a housing rear part (holding part) 63 that constitutes the rear part of the second housing 60 and holds the cables 91, 92. The housing rear part 63 may be insert-molded together with the cables 91, 92. That is, in the molding step of the housing rear part 63, the resin material of the housing rear part 63 may be injected into a mold in a state where a part of each of the cables 91, 92 is placed inside the mold to mold the housing rear part 63. With this structure, the cables 91, 92 can be held firmly.

As described above, the cables 91, 92 are bent rearward and upward and extend obliquely rearward and upward from the housing rear part 63 of the second connector C2. The housing rear part 63 may hold bent parts of the cables 91, 92. The housing rear part 63 can fix the extending direction of the cables 91, 92 to be fixed and increase the arrangement density of the plurality of connector assemblies 1.

Figure 4:
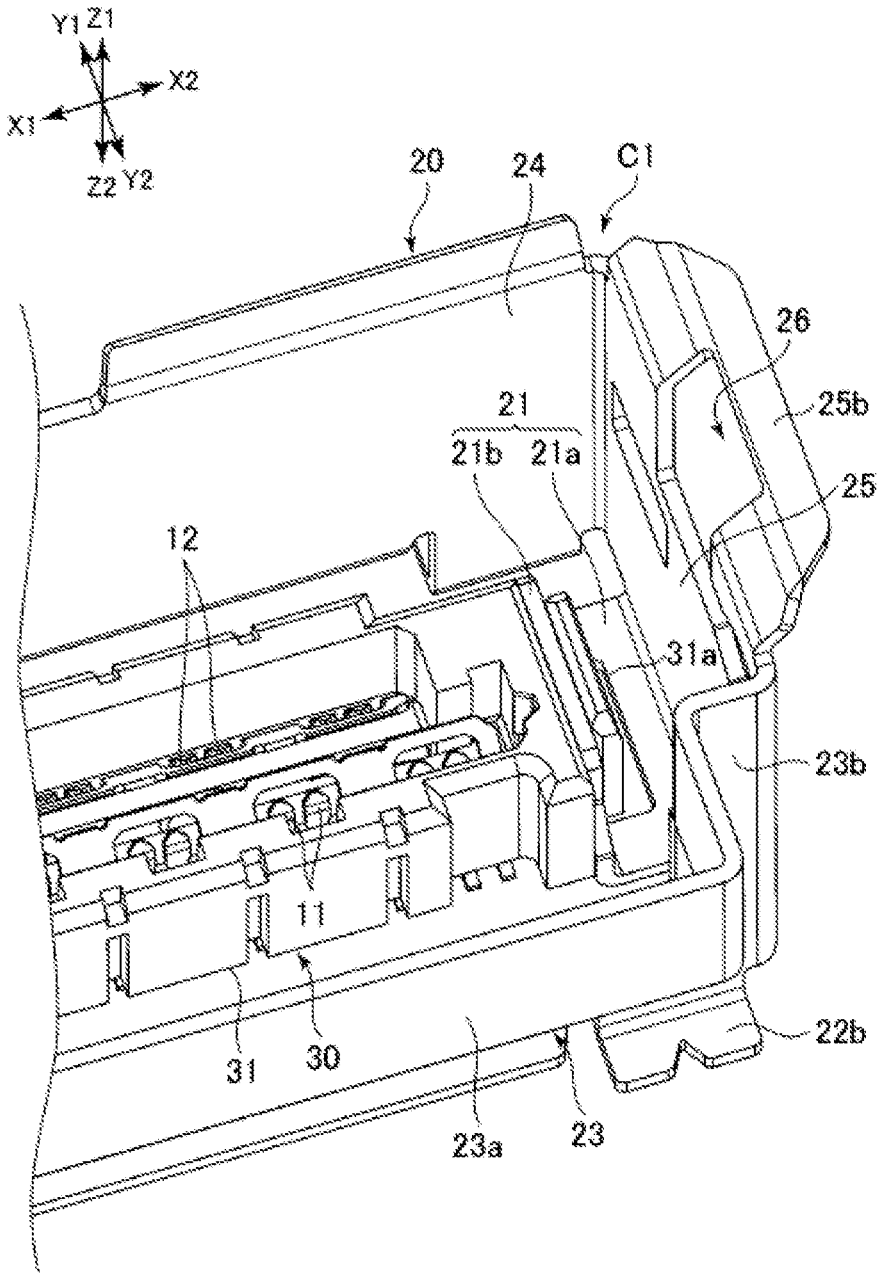
FIG. 4 is a perspective view illustrating the inside of the first connector.
Figure 7:
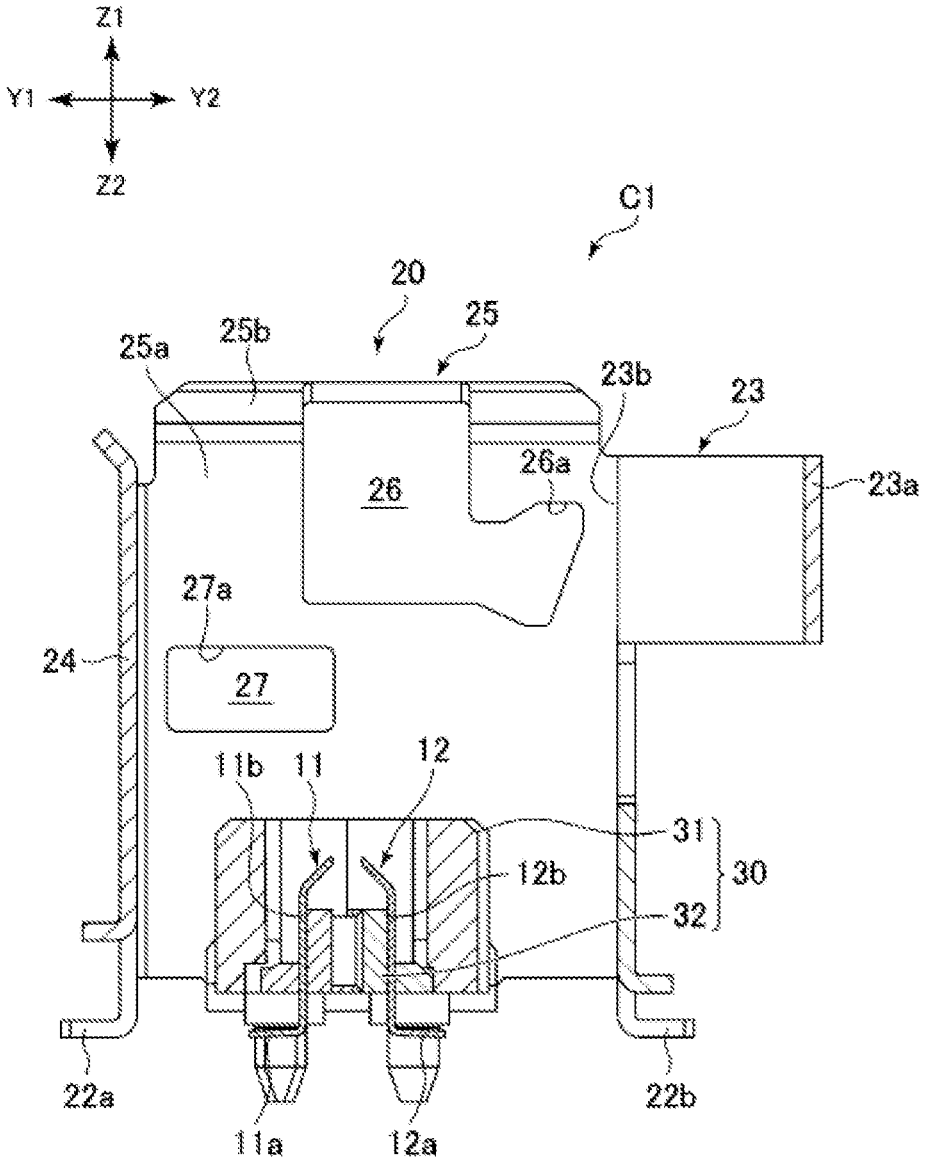
FIG. 7 is a cross-sectional view of the first connector taken along line VI-VI illustrated in FIG. 5.

As illustrated in FIG. 4, the first connector C1 may include a plurality of front terminals 11 held by the first housing 30 and arranged in the horizontal direction and a plurality of rear terminals 12 held by the first housing 30 and arranged in the horizontal direction. As illustrated in FIG. 7, the respective terminals 11, 12 may have attached parts 11*a*, 12*a* exposed on the lower side of the first housing 30, and contacts 11*b*, 12*b* extending upward from the attached parts 11*a*, 12*a* and held by the first housing 30. When the first connector C1 is mounted on the circuit board, the attached parts 11*a*, 12*a* may be soldered to a conductor part formed on the circuit board. When the first connector C1 and the second connector C2 are connected (when the connectors are in the locked state to be described later), the terminals 51, 52 of the second connector C2 come into contact with the contacts 11*b*, 12*b*, respectively (cf. FIG. 10B). The first housing 30 may have an outer wall 31 surrounding the plurality of terminals 11, 12, and a central part 32 disposed between the front terminal 11 and the rear terminal 12 and holding the terminals 11, 12. The terminals 11, 12 may be exposed inside the outer wall 31.

As illustrated in FIG. 2, the first connector C1 may include a frame 20. The frame 20 has a substantially rectangular shape surrounding the second connector C2 in a plan view. The frame 20 may have a front wall 24 disposed along the front side of the second housing 60, a rear wall 23 disposed along the rear side of the second housing 60, and right and left sidewalls 25 disposed along the side surfaces of the second housing 60.

The first housing 30 may be disposed inside the frame 20 and fixed to the frame 20. As illustrated in FIG. 4, the frame 20 has a housing fixing part 21 extending from the lower edge of the sidewall 25 to the inside of the frame 20. The housing fixing part 21 may be fixed to an end 31*a* of the first housing 30 (outer wall 31) in the horizontal direction. For example, the housing fixing part 21 may have a bottom 21*a* extending from the lower edges of the right and left sidewalls 25 to the inside of the frame 20, and a hook 21*b* extending upward from the bottom 21*a*. An opening is formed in each of the bottom 21*a* and a hook 21*b*, and the end 31*a* of the first housing 30 (outer wall 31) is fitted into the opening. The hook 21*b* is caught on the upper side of the first housing 30 and regulates the upward relative movement of the first housing 30 (outer wall 31) with respect to the frame 20. With this structure, the movement of the first housing 30 is regulated by the frame 20, so that it is possible to regulate the separation of the first housing 30 (more specifically, the terminals 51, 52) from the circuit board. A groove may be formed at the end 31*a* of the first housing 30. The upper part of the hook 21*b* may be fitted in the groove.

The frame 20 may open downward (cf. FIG. 7). When the connectors C1, C2 are connected (when the connectors are in the locked state), the lower end of the second connector C2 may be in contact with the circuit board mounted with the connector C1.

As illustrated in FIG. 3, the frame 20 may have a plurality of attached parts 22*a*, 22*b* on the lower edge. The attached parts 22*a*, 22*b* are portions that are soldered to the circuit board mounted with the first housing 30. As illustrated in FIG. 7, the frame 20 may have, for example, an attached part 22*a* bent forward from the lower edge of the front wall 24. The frame 20 may have, for example, an attached part 22*b* bent rearward from the lower edge of the rear wall 23. The attached parts 22*a*, 22*b* may be formed on lower edges of the ends of the front wall 24 and the rear wall 23 in the horizontal direction.

The distance between the front wall 24 and the rear wall 23 of the frame 20 may correspond to the size of the second housing 60 in the front-rear direction. Thereby, the forward inclination of the second connector C2 with respect to the first housing 30 can be regulated by the front wall 24 of the frame 20, and conversely, the rearward inclination of the second connector C2 can be regulated by the rear wall 23 of the frame 20.

As illustrated in FIG. 2, the second housing 60 has a positioning surface 62*b* on the front surface. The positioning surface 62*b* protrudes forward from the other portion of the front surface of the second housing 60, and the distance between the positioning surface 62*b* and the front wall 24 of the frame 20 may be smaller than the distance between the other portion of the front surface of the second housing 60 and the front wall 24 (cf. FIG. 5). The forward inclination of the second connector C2 with respect to the first housing 30 can be regulated by the collision between the front wall 24 of the frame 20 and the positioning surface 62*b*. The distance between the positioning surface 62*b* and the front wall 24 of the frame 20 may be, for example, smaller than the thickness of the front wall 24 of the frame 20. The positioning surface 62*b* may be positioned at the end of the second housing 60 in the horizontal direction.

Figure 5:
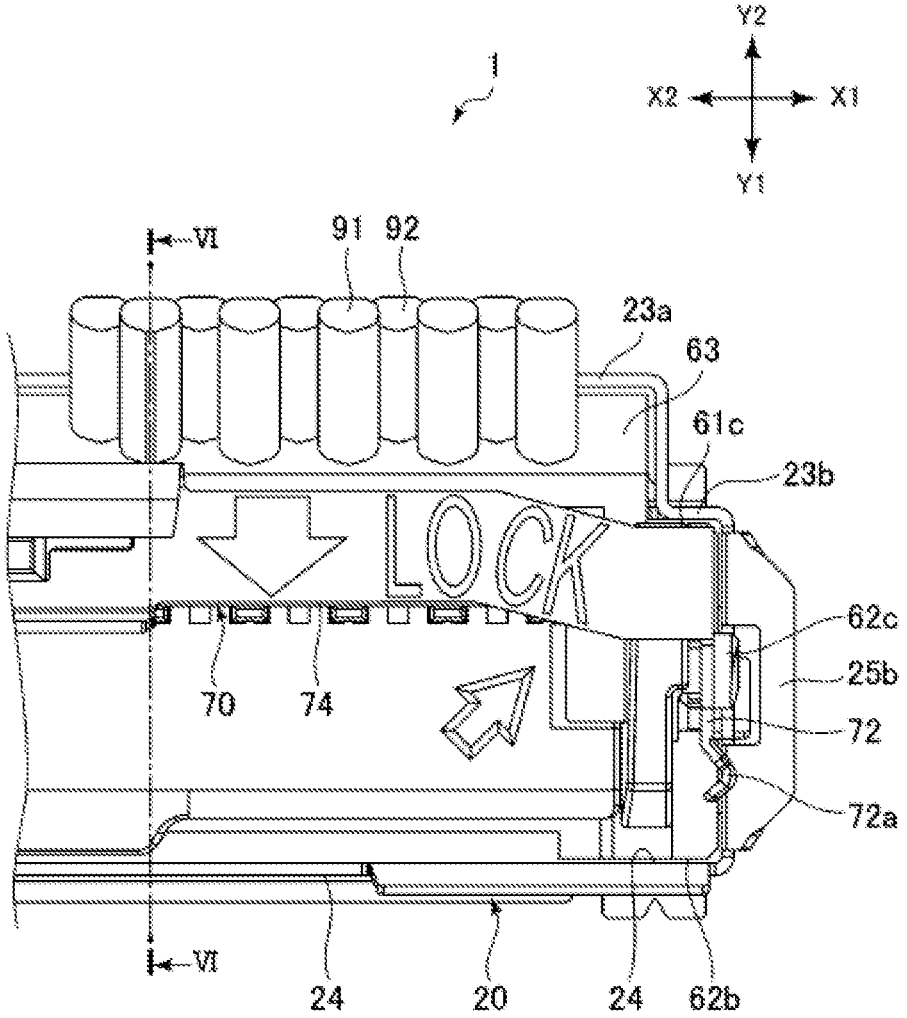
FIG. 5 is a plan view of the connector assembly. In this figure, the lock lever is disposed in the unlock position.

As illustrated in FIG. 5, the rear wall 23 of the frame 20 may have a positioning part 23*b*. The distance between the positioning part 23*b* and a rear surface 61*c* of the second housing 60 is smaller than the distance between the other portion of the rear wall 23 and the rear surface of the second housing 60. As a result, the rearward inclination of the second connector C2 with respect to the first housing 30 can be regulated by a collision between the positioning part 23*b* of the frame 20 and the rear surface 61*c* of the second housing 60. The distance between the positioning part 23*b* of the frame 20 and the rear surface 61*c* of the second housing 60 may be, for example, smaller than the thickness of the frame 20.

The positioning part 23*b* may be formed at a position shifted leftward or rightward with respect to a portion holding the cables 91, 92 in the second housing 60 (the housing rear part 63 in the example of the second connector C2). The positioning part 23*b* may be positioned, for example, at the end of the rear wall 23 in the horizontal direction.

The rear wall 23 of the frame 20 may have a lateral extension 23*a* positioned between the right and left positioning parts 23*b* and disposed along the housing rear part 63 of the second housing 60. The lateral extension 23*a* extends from one positioning part 23*b* to the other positioning part 23*b*. The lateral extension 23*a* protrudes rearward with respect to the right and left positioning parts 23*b*. The rear wall 23 may have an opening on the lower side of the lateral extension 23*a* (cf. FIG. 3).

Figure 10A:
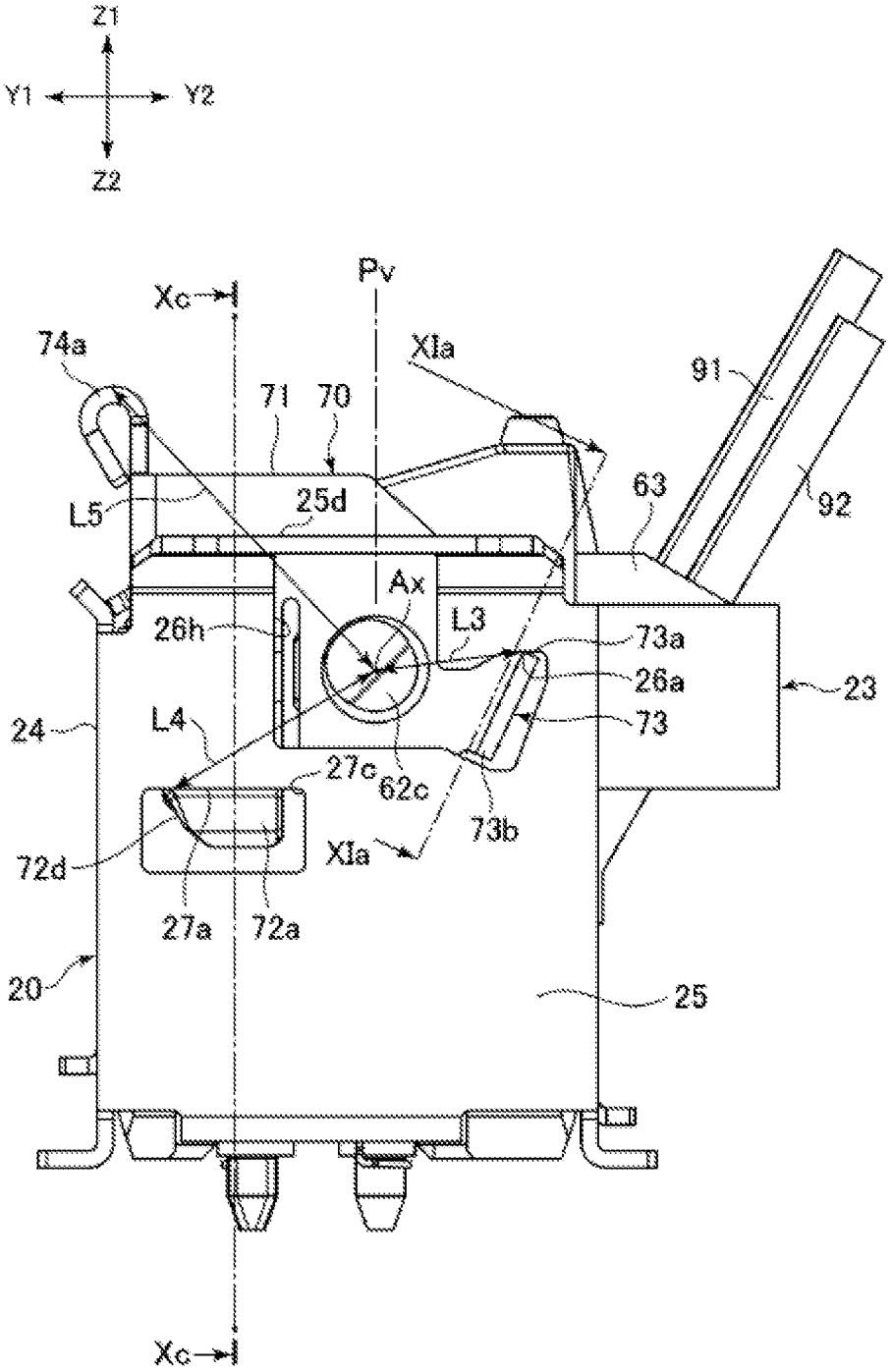
FIG. 10A is a side view of the first connector and the second connector in a locked state.
Figure 10B:
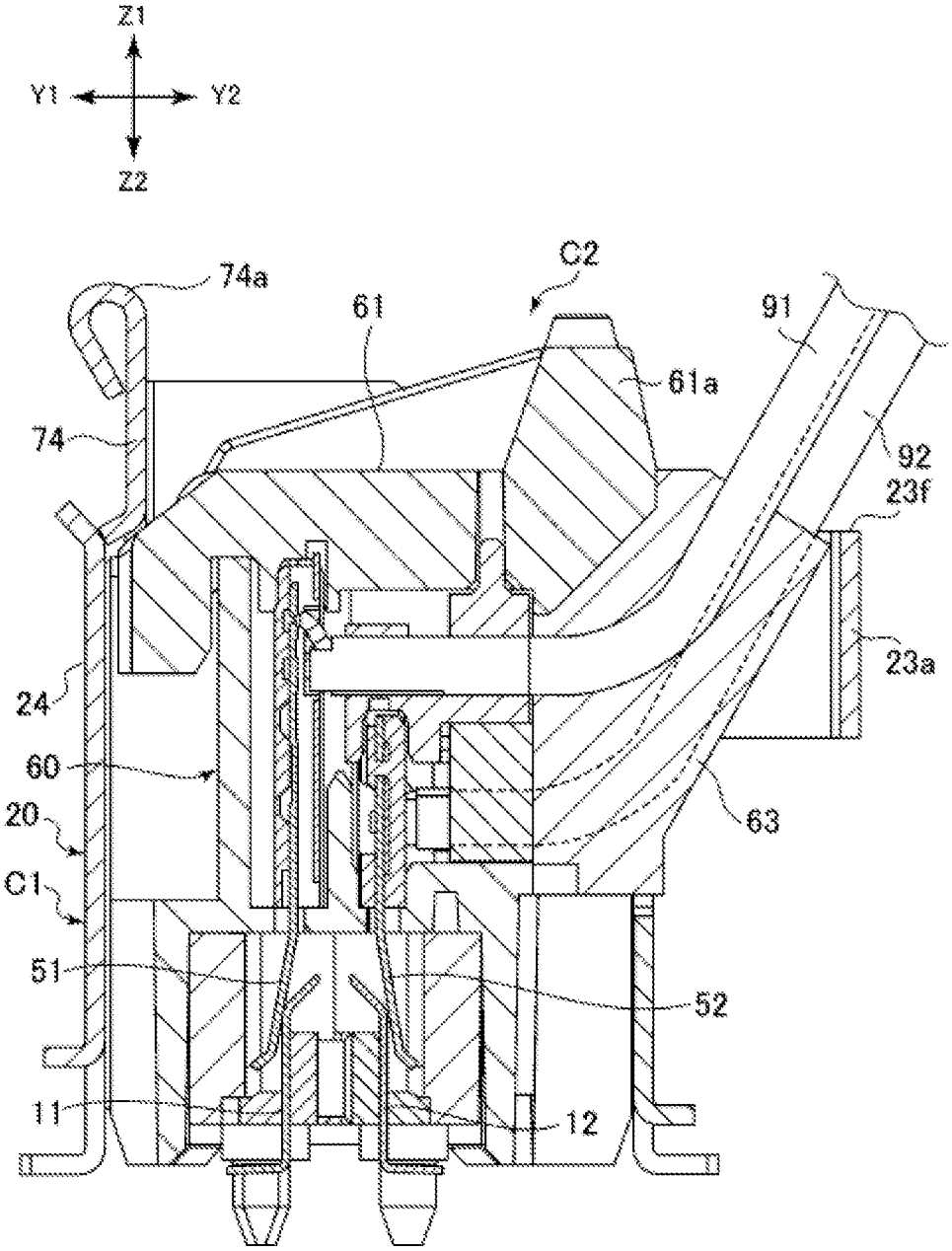
FIG. 10B is a cross-sectional view of the first connector and the second connector in the state illustrated in FIG. 10A. The cut surface is the same as in FIG. 6.

As illustrated in FIG. 10B, in a state where the first connector C1 is connected to the second connector C2 (in the locked state of the connectors), the upper part of the front wall 24 of the frame 20 is positioned on the front side of the front surface of the upper part (housing upper part 61) of the second housing 60. That is, the height of the front wall 24 of the frame 20 corresponds to the height of the second housing 60. The rear wall 23 (more specifically, see the positioning part 23*b* in FIG. 5) of the frame 20 is also positioned on the rear side of the upper part of the second housing 60 (the housing upper part 61). The height of the rear wall 23 of the frame 20 corresponds to the height of the second housing 60. Similarly, the height of the sidewall 25 of the frame 20 also corresponds to the height of the second housing 60. Thus, most of the second housing 60 is disposed inside the frame 20 in the vertical, front-rear, and horizontal directions, and the inclination of the second connector C2 in the front-rear and horizontal directions with respect to the first housing 30 can be effectively regulated by the frame 20.

As illustrated in FIG. 6, a tip of the cable 92 connected to the rear terminal 52 (a portion extending rearward from the rear terminal 52) is lower than a tip of the cable 91 connected to the front terminal 51 (a portion extending rearward from the rear terminal 51). This has enabled an increase in the arrangement density of the cables 91, 92. As illustrated in FIG. 10B, in a state where the first connector C1 is connected to the second connector C2 (in the locked state to be described later), the height of the front wall 24 and the rear wall 23 of the frame 20 is higher than the position of the tip of the upper cable 91 (the portion extending rearward from the rear terminal 51). Thereby, the inclination of the second connector C2 in the front-rear direction with respect to the first housing 30 can be effectively regulated by the frame 20. The arrangement of the terminals 51, 52 and the cables 91, 92 is not limited to the example of the connector assembly 1. For example, the number of rows of the terminals arranged in the horizontal direction may be one or three or more. In this case, the upper edge of the frame may be higher than the end of the cable (the portion extending rearward from the terminal).

As illustrated in FIG. 2, the second connector C2 includes a lock lever 70. The lock lever 70 is movable between the lock position (the position of the lock lever 70 illustrated in FIG. 1) in which the lock lever 70 engages with the frame 20 and the unlock position (the position of the lock lever 70 illustrated in FIG. 2) in which the engagement with the frame 20 is released. The lock lever 70 may be rotatable between the lock position and the unlock position about an axis line Ax intersecting a connection direction of the first connector C1 and the second connector C2 (a direction in which the connectors C1, C2 approach each other in the vertical direction). More specifically, the lock lever 70 may be rotatable about the axis line Ax along the horizontal direction. When the right side surface (cf. FIG. 8) of the second connector C2 is viewed, the lock position is defined in the counterclockwise rotation direction about the axis line Ax with respect to the unlock position. The lock lever 70 disposed at the lock position is engaged with the first connector C1 to regulate the separation of the first connector C1 and the second connector C2. In the following description, a rotation direction from the unlock position to the lock position is referred to as a "lock direction", and a rotation direction from the lock position to the unlock position is referred to as an "unlock direction".

As illustrated in FIG. 2, the lock lever 70 has side parts 71 disposed along the right and left side surfaces of the second housing 60. A lever attaching part 62*c* positioned on the axis line Ax mounts the side part 71 on the side surface of the second housing 60 so as to allow the rotation of the side part 71 about the axis line Ax. The lever attaching part 62*c* may be a portion integrally formed with the second housing 60 or may be a screw. The lock lever 70 has a lateral extension 74 extending between the right and left side parts 71. When the lock lever 70 is in the unlock position (cf. FIG. 2), the lateral extension 74 is positioned above the second housing 60. When the lock lever 70 is at the lock position (cf. FIG. 1), the lateral extension 74 is positioned on the front side of the second housing 60.

As illustrated in FIG. 2, the lock lever 70 may have a first engaged part 73 and a second engaged part 72*a* on the side part 71. The first connector C1 may include a first engaging part 26*a* and a second engaging part 27*a*. In the example of the first connector C1, the first engaging part 26*a* and the second engaging part 27*a* are formed on the sidewall 25 of the frame 20. As described above, since the engaged parts 73, 72*a* are formed on the side part 71 instead of the lateral extension 74, and the engaging parts 26*a*, 27*a* are formed on the sidewall 25 instead of the front wall 24, it has been possible to make small the size of the connector assembly 1 in the front-rear direction.

As illustrated in FIG. 2, the second engaging part 27*a* may be a part of the edge of a hole, a recess, or a notch formed in the sidewall 25. The first engaging part 26*a* may also be a part of the edge of a hole, a recess, or a notch formed in the sidewall 25. In the example of the first connector C1, which is the embodiment of the present disclosure, a hole 27 and a hole 26 are formed in the sidewall 25. Hereinafter, the hole 27 is referred to as a "fitting hole". The upper edge of the fitting hole 27 is the second engaging part 27*a*. The hole 26 is referred to as a "passage hole". In the example of the first connector C1, a part of the edge of the passage hole 26 is the first engaging part 26*a*. As described later, the passage hole 26 has a passage region 26*e* (cf. FIG. 8) extending in the connection direction (vertical direction) of the connectors C1, C2 and an engagement region 26*f* (cf. FIG. 8) defined behind the passage region 26*e*. The upper portion of the edge of the engagement region 26*f* functions as the first engaging part 26*a* and regulates the upward movement of the first engaged part 73.

The first engaging part 26*a* is engaged with the first engaged part 73 of the lock lever 70 in a state where the lock lever 70 is at the lock position (cf. FIG. 1) to regulate the separation of the first connector C1 and the second connector C2 in the vertical direction. In a state where the lock lever 70 is at the lock position (cf. FIG. 1), the first engaged part 73 is disposed inside the rear part (cf. the engagement region 26*f* in FIG. 8) of the passage hole 26 formed in the sidewall 25 and is positioned below the first engaging part 26*a* (the upper portion of the rear edge of the passage hole 26). Therefore, the first engaging part 26*a* regulates the movement of the first engaged part 73 in the separation direction of the first connector C1 and the second connector C2. More specifically, the first engaging part 26*a* regulates the upward movement of the first engaged part 73. (Here, the separation direction is a direction in which the first connector C1 and the second connector C2 are separated from each other and is a downward direction for the connector C1 and an upward direction for the connector C2.) In the following description, a state where the lock lever 70 is at the lock position (cf. FIG. 1) is referred to as a "locked state". Here, that the first engaging part 26*a* and the first engaged part 73 are engaged with each other means that the two parts 26*a*, 73 are in a positional relationship in which the first engaging part 26*a* regulates the upward movement of the first engaged part 73.

The lock lever 70 may be formed of a metal material. The lock lever 70 may be formed by sheet metal working. The frame 20 may also be formed of a metal material. The frame 20 may also be formed by sheet metal working. Unlike the examples of the connectors C1, C2, one or both of the lock lever 70 and the frame 20 may be made of resin.

As illustrated in FIG. 2, the first engaged part 73 may be a portion bent in the horizontal direction (the direction along the axis line Ax). That is, the first engaged part 73 on the right side may be a portion bent rightward, and the first engaged part 73 on the left side may be a portion bent leftward. The first engaged part 73 may have an edge 73*a* (cf. FIG. 8) oriented in a direction intersecting the axis line Ax. The edge 73*a* is the edge of the sheet that is the material of the lock lever 70. As illustrated in FIG. 10A, when the lock lever 70 is in the lock position, the edge 73*a* is oriented obliquely upward. Hereinafter, this edge 73*a* is referred to as a "collision edge". The first engaging part 26*a* (a part of the edge of the passage hole 26) may be positioned above the collision edge 73*a*. With the first engaged part 73 formed in this shape, the strength of the first engaged part 73 against a force to separate the second connector C2 from the first connector C1 can be increased. That is, the deformation of the first engaged part 73 can be prevented. When the lock lever 70 is in the lock position, the collision edge 73*a* may be in contact with the first engaging part 26*a*.

In the example of the connectors C1, C2, the collision edge 73*a* of the first engaged part 73 is oriented obliquely rearward and upward in the locked state of the connectors C1, C2. As described above, the cables 91, 92 are also oriented obliquely rearward and upward from the second housing 60. Therefore, in the locked state, the first engaged part 73 has high strength against a force that pulls the cables 91, 92 in the extending direction thereof.

The shapes of the first engaging part 26*a* and the first engaged part 73 are not limited to the examples of the connectors C1, C2. For example, contrary to the example of the connectors C1, C2, the first engaging part 26*a* may be a portion bent inward (toward the inside of the frame 20) in the horizontal direction (the direction along the axis line Ax) instead of the first engaged part 73. The lock lever 70 may have, as the first engaged part 73, a portion that is positioned below the first engaging part 26*a* and the upward movement of which is regulated by the first engaging part 26*a*. In this case, the first engaging part 26*a* may have an edge oriented in the direction intersecting the axis line Ax, and this edge may be in contact with the first engaged part 73 to regulate the upward movement of the first engaged part 73.

As illustrated in FIG. 2, the lock lever 70 may have an elastic part 72 on the side part 71. The elastic part 72 is elastically deformable in the horizontal direction. In the example of the connector assembly 1, the elastic part 72 is elastically deformable in the direction along the axis line Ax. The elastic part 72 may have, for example, a plate shape extending in the direction intersecting the axis line Ax. The second engaged part 72*a* is formed in the elastic part 72. Thus, the second engaged part 72*a* can be displaced in the horizontal direction (the direction along the axis line Ax) by the elastic deformation of the elastic part 72.

Figure 10C:
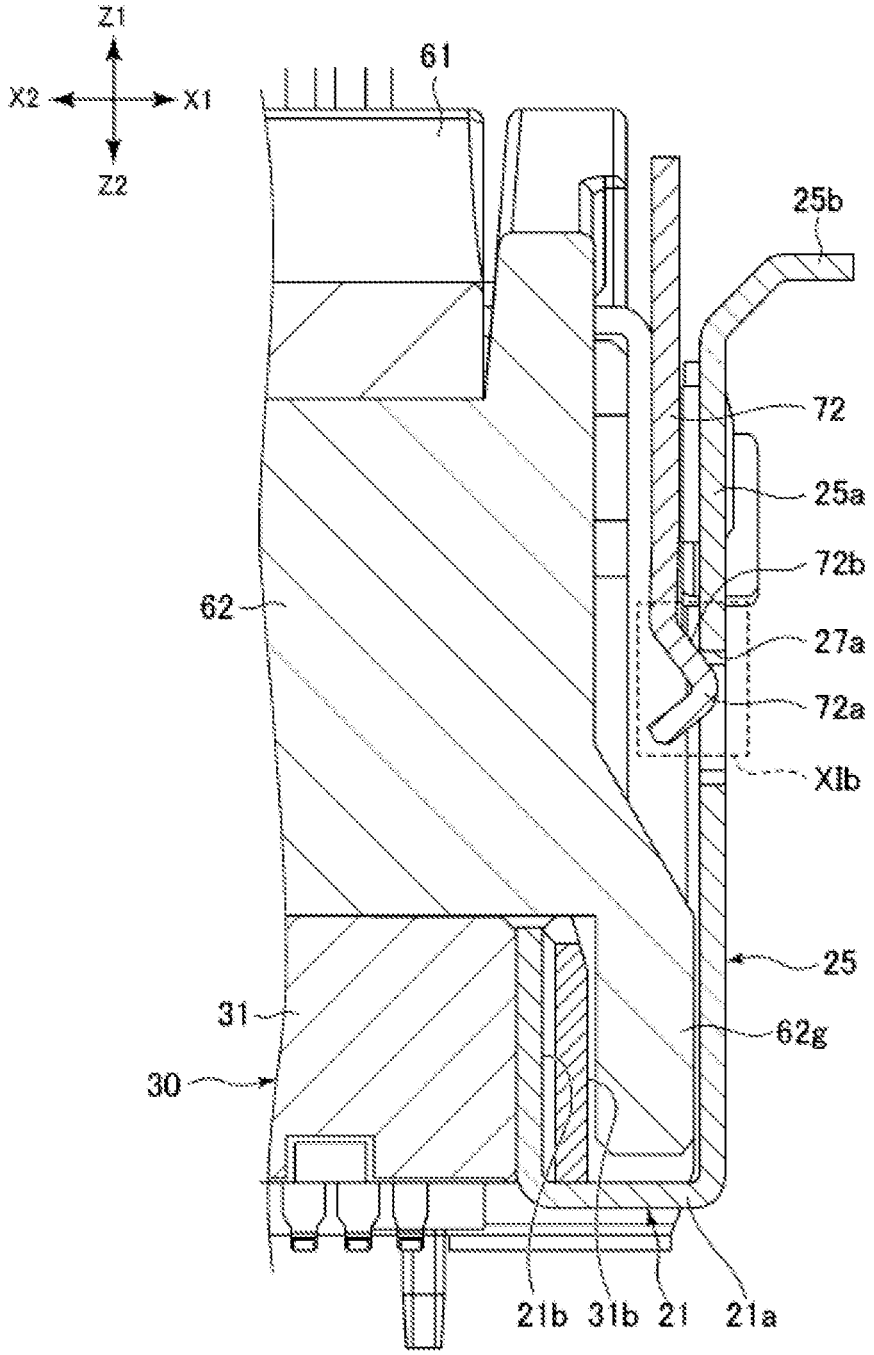
FIG. 10C is a cross-sectional view of the connector assembly taken along line Xc-Xc illustrated in FIG. 10A.

As illustrated in FIG. 10C, in the locked state of the connectors C1, C2, the elastic part 72 is elastically deformed in the horizontal direction, and the second engaged part 72*a* is brought into contact with the second engaging part 27*a* of the frame 20. For example, in the locked state of the connectors C1, C2, the elastic part 72 may be curved toward the inside of the frame 20 than in a free state of the elastic part 72 (a state where no external force is acting). In the locked state of the connectors C1, C2, the second engaged part 72*a* may be pressed against the second engaging part 27*a* by an elastic force generated by the deformation of the elastic part 72. With this structure, it is possible to effectively prevent the relative positions of the connectors C1, C2 from changing in the horizontal direction. For example, it is possible to prevent the relative positions of the connectors C1, C2 from changing in the horizontal direction due to slight vibration.

The first engaged part 73, the second engaged part 72*a*, and the elastic part 72 may be formed on each of the two side parts 71 (right and left side parts 71) positioned on opposite sides in the horizontal direction. In addition, the first engaging part 26*a* and the second engaging part 27*a* may be formed on each of the two sidewalls 25 (right and left sidewalls 25) positioned on opposite sides in the horizontal direction. With this structure, in the locked state of the connectors C1, C2, the second connector C2 is positioned at the center of the frame 20 of the first connector C1 in the horizontal direction (the direction along the axis line Ax).

Note that the first engaged part 73 described above is formed in a portion having higher rigidity than the elastic part 72 in the horizontal direction. Thus, the displacement of the first engaged part 73 in the horizontal direction is less likely to occur than the displacement of the second engaged part 72*a*. Therefore, when the force to separate the connectors C1, C2 acts on the connectors C1, C2, the engagement between the first engaged part 73 and the first engaging part 26*a* can act effectively. In the example of the first connector C1, the sidewall 25 of the lock lever 70 has a portion 71*b* (cf. FIG. 8) extending from the lever attaching part 62*c* toward the first engaged part 73. A width W1 of the portion 71*b* is ensured such that the displacement of the first engaged part 73 in the horizontal direction is less likely to occur than the displacement of the second engaged part 72*a*. Means for ensuring the rigidity of the portion 71*b* is not limited to the example illustrated here. For example, the portion 71*b* may be formed of a material different from other portions, or a rib for ensuring the rigidity of the portion 71*b* may be formed in the portion 7*b*.

As illustrated in FIG. 10C, the second housing 60 has a fitting part 62*g* that fits into a gap between an end surface 31*b* (an end surface in the horizontal direction) of the first housing 30 and the sidewall 25. The thickness of the fitting part 62*g* in the horizontal direction may be set in accordance with the distance between the sidewall 25 and the end surface 31*b*. Accordingly, the sidewall 25 also regulates a change in the relative position of the connectors C1, C2 in the horizontal direction.

Note that the elastic part elastically deformable in the horizontal direction (the elastic part 72 in the connector assembly 1) may be formed in the frame 20 instead of the lock lever 70. In this case, the second engaging part 27*a* may be formed in the elastic part and be displaceable in the horizontal direction. In this case, a hole, a recess, or a notch into which the second engaging part 27*a* is fitted may be formed in the side part 71 of the lock lever 70.

As illustrated in FIG. 10C, the second engaged part 72*a* of the lock lever 70 may be a protrusion protruding in the horizontal direction (direction along the axis line Ax). More specifically, the second engaged part 72*a* formed on the right side part 71 may protrude rightward, and the second engaged part 72*a* formed on the left side part 71 may protrude leftward. The second engaging part 27*a* of the frame 20 is positioned in the unlock direction (a direction from the lock position to the unlock position) with respect to the second engaged part 72*a*. When the connectors C1, C2 are viewed in the horizontal direction (the direction intersecting the axis line Ax), the second engaged part 72*a* at least partially overlaps the second engaging part 27*a*. Thereby, the movement of the second engaged part 72*a* in the unlocking direction is regulated by the second engaging part 27*a*, and the rotation of the lock lever 70 can be prevented effectively.

As illustrated in FIG. 10A, in the locked state of the connectors C1, C2, the second engaging part 27*a* and the second engaged part 72*a* are positioned in front of the axis line Ax. In the locked state of the connectors C1, C2, the second engaging part 27*a* of the frame 20 is positioned above the second engaged part 72*a*.

The positions of the second engaging part 27*a* and the second engaged part 72*a* are not limited to the example of the connectors C1, C2. For example, in the locked state of the connectors C1, C2, the second engaging part 27*a* and the second engaged part 72*a* may be positioned below the axis line Ax. In this case, the second engaging part 27*a* may be positioned in front of the second engaged part 72*a*. In this case as well, the second engaging part 27*a* can regulate the movement of the second engaged part 72*a* in the unlocking direction.

The structures of the second engaging part 27*a* and the second engaged part 72*a* are not limited to the example of the connectors C1, C2. For example, the second engaging part 27*a* of the frame 20 may be a protrusion protruding toward the inside of the frame 20. On the other hand, the second engaged part 72*a* of the lock lever 70 may be a hole, a recess, or a notch into which the second engaging part 27*a* as a protrusion is fitted. In this structure as well, the second engaging part 27*a* of the frame 20 may be positioned in the unlock direction with respect to the second engaged part 72*a*. This effectively prevents the lock lever 70 at the lock position from rotating towards the unlock position.

As illustrated in FIG. 10C, the second engaged part 72*a* may have an inclined surface 72*b*. The inclined surface 72*b* may be positioned in the locking direction with respect to the second engaging part 27*a* (the edge of the fitting hole 27) of the frame 20 (may be positioned "below" the second engaging part 27*a* in the example of the connectors C1, C2). In the locked state of the connectors C1, C2, the elastic part 72 may be elastically deformed in the horizontal direction (the direction along the axis line Ax). More specifically, the elastic part 72 may be bent toward the center in the horizontal direction. The inclined surface 72*b* is pressed against the second engaging part 27*a* by the elastic force of the elastic part 72, and a force that presses the second engaged part 72*a* in the locking direction is generated. As a result, as illustrated in FIG. 10A, in the locked state of the connectors C1, C2, the first engaged part 73 is pressed against the first engaging part 26*a* to effectively prevent the relative movement of the connectors C1, C2 (e.g., the upward movement of the second connector C2).

As described above, the edge 73*a* of the first engaged part 73 (the edge of the sheet that is the material of the lock lever 70) is in contact with the first engaging part 26*a*. On the other hand, in the second engaged part 72*a*, the inclined surface 72*b* (the surface of the sheet that is the material of the lock lever 70) is in contact with the second engaging part 27*a*.

Figure 11A:
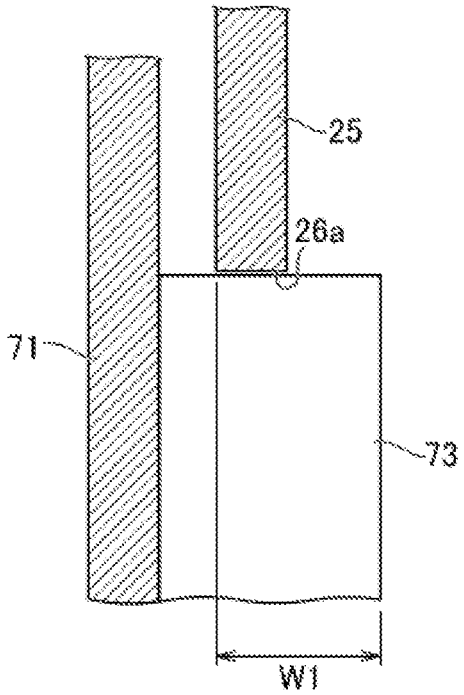
FIG. 11A is a cross-sectional view taken along line XIa-XIa illustrated in FIG. 10A.
Figure 11B:
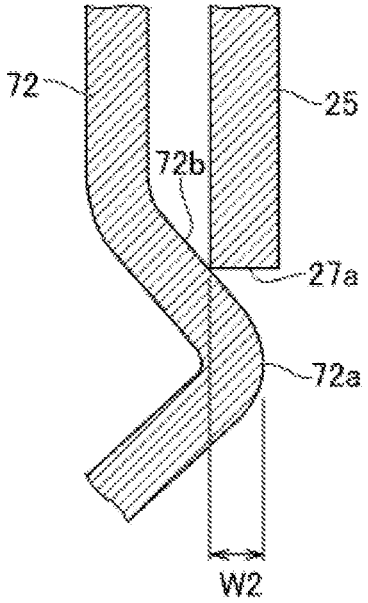
FIG. 11B is an enlarged view of a region XIb illustrated in FIG. 10A.

As illustrated in FIG. 11A, in the locked state of the connectors C1, C2, the first engaged part 73 exceeds the first engaging part 26*a* by a first width W1 in the horizontal direction. Specifically, the first engaged part 73 exceeds the inner surface of the sidewall 25 of the frame 20 by the first width W1. On the other hand, as illustrated in FIG. 11B, the second engaged part 72*a* exceeds the second engaging part 27*a* by a second width W2 in the horizontal direction in the locked state of the connectors C1, C2. Specifically, the second engaged part 72*a* exceeds the inner surface of the sidewall 25 of the frame 20 by the second width W2. The first width W1 is larger than the second width W2. With this structure, it is possible to more effectively prevent the unintended disengagement of the first engaging part 26*a* and the first engaged part 73.

Figure 8:
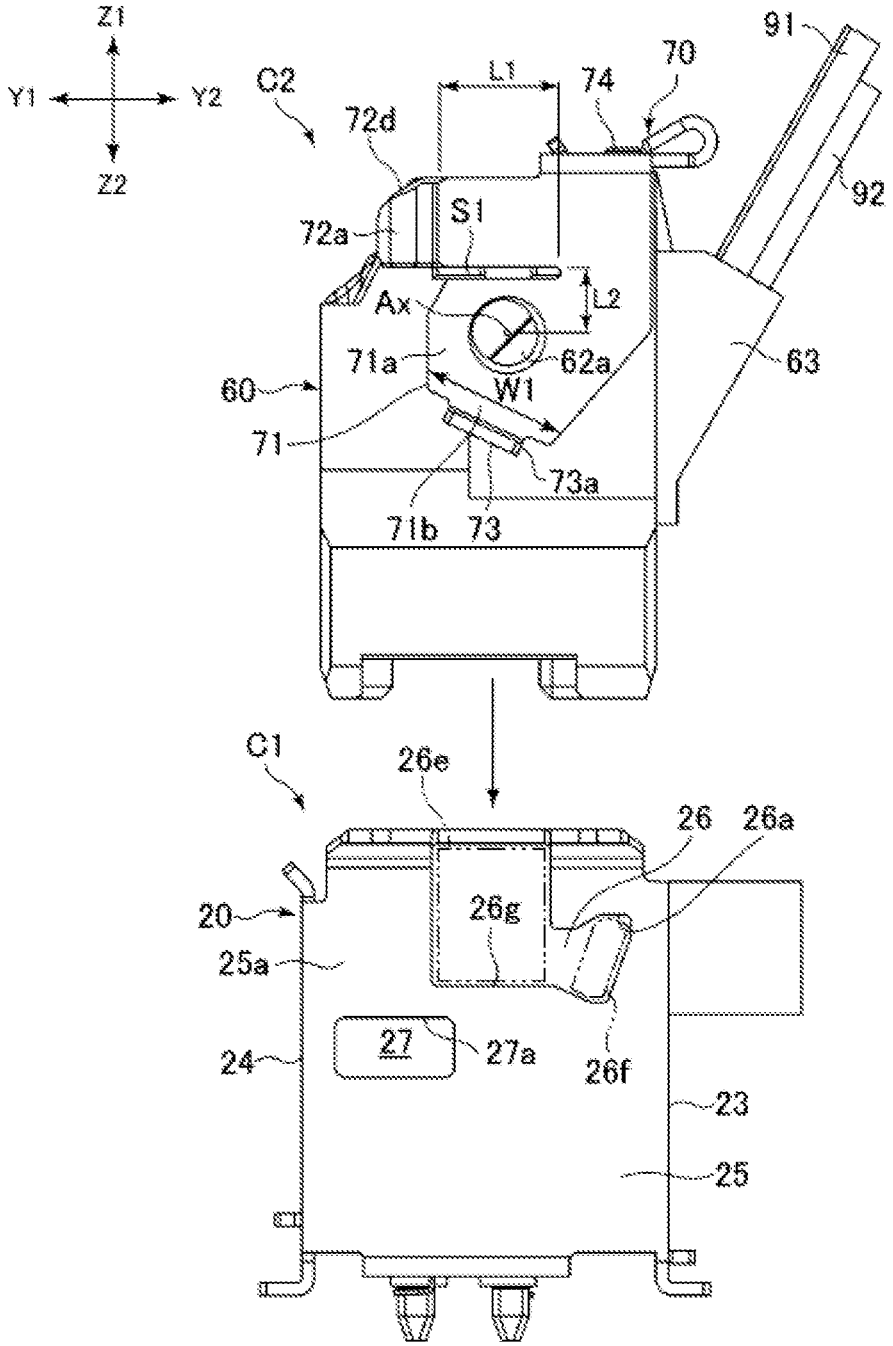
FIG. 8 is a side view of the first connector and the second connector separated from each other in the vertical direction.
Figure 9A:
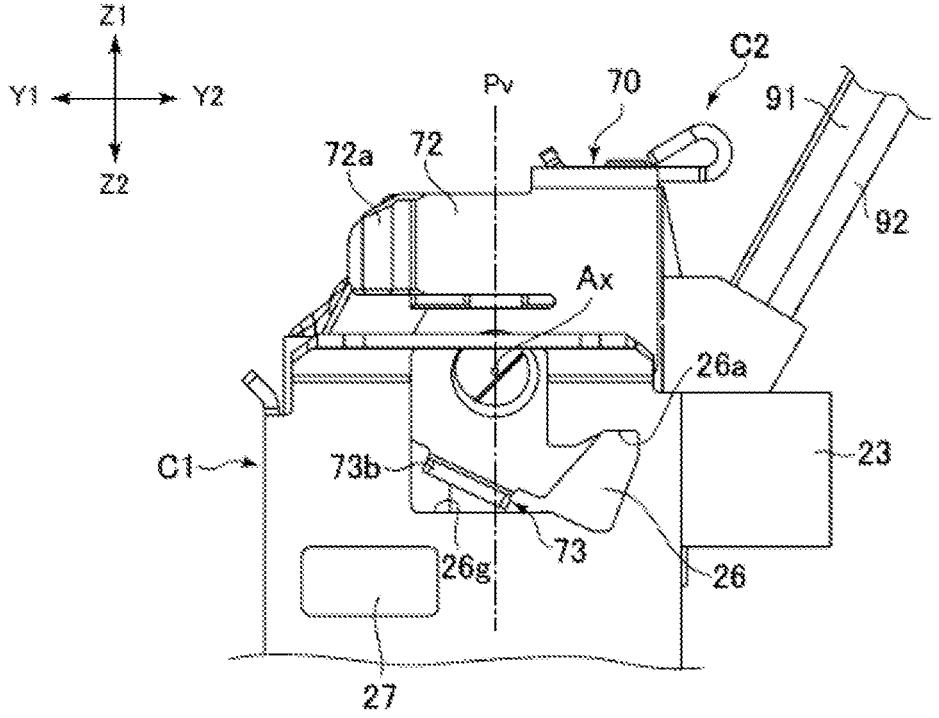
FIG. 9A is a side view of the first connector and the second connector in the process of connection.
Figure 9B:
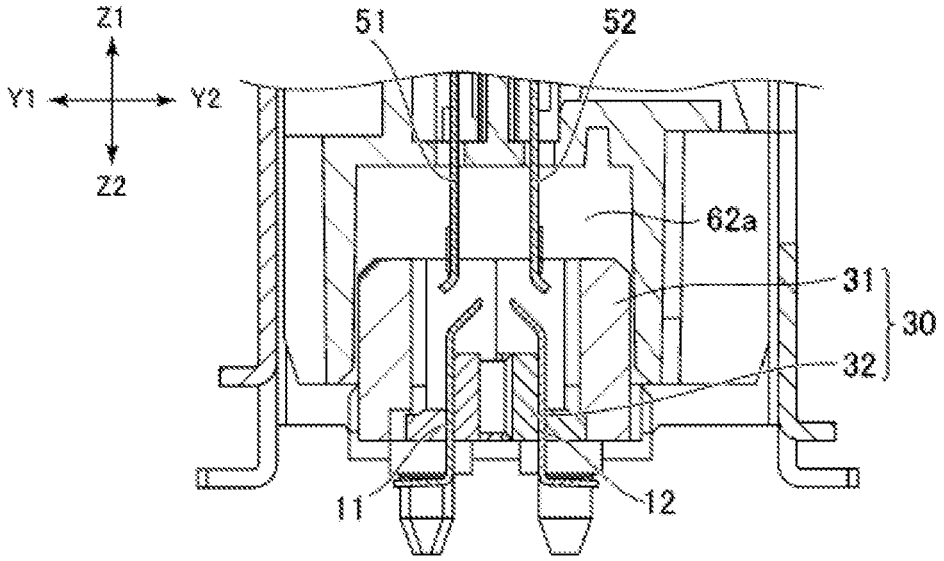
FIG. 9B is a cross-sectional view of the first connector and the second connector in the state illustrated in FIG. 9A. The cut surface is the same as in FIG. 6.

As illustrated in FIG. 8, a passage hole 26 is formed in the sidewall 25 of the frame 20. The passage hole 26 has a passage region 26*e* extending in the connection direction of the connectors C1, C2 and an engagement region 26*f* defined behind the passage region 26*e*. As illustrated in FIG. 9A, when the second connector C2 in which the lock lever 70 is disposed at the unlock position is fitted into the frame 20, the first engaged part 73 passes through the passage region 26*e* and collides with a lower edge 26*g* (a stopper part) of the passage region 26*e*. Hereinafter, this state illustrated in FIG. 9A is referred to as an "intermediate stop state". As illustrated in FIG. 9B, in this intermediate stop state, the terminals 51, 52 of the second connector C2 have not reached the terminals 11, 12 of the first connector C1.

As illustrated in FIG. 4, the right and left sidewalls 25 of the frame 20 have guide parts 25*b* at the uppermost parts. The guide part 25*b* extends upward and opens outward in the horizontal direction. As illustrated in FIG. 5, when the lock lever 70 at the unlock position is viewed in a plan view, the second engaged part 72*a* partially overlaps the guide part 25*b*. Therefore, in the process of rotating the lock lever 70 toward the lock position, the second engaged part 72*a* comes into contact with the guide part 25*b* and is guided to the inner side of the frame 20. The second connector C2 is pushed toward the center in the horizontal direction (the center in the direction along the axis line Ax).

When the lock lever 70 is rotated from the unlock position toward the lock position, the first engaged part 73 moves toward the engagement region 26*f* (cf. FIG. 8) about the axis line Ax, and the second engaged part 72*a* moves toward the fitting hole 27 about the axis line Ax. When the lock lever 70 reaches the lock position, the first engaged part 73 is disposed in the engagement region 26*f*, and the second engaged part 72*a* is disposed in the fitting hole 27. At this time, as illustrated in FIG. 10B, the terminals 51, 52 of the second connector C2 come into contact with the terminals 11, 12 of the first connector C1.

As illustrated in FIG. 8, the frame 20 has an interference part 25*a* on the sidewall 25. The interference part 25*a* is positioned in a region through which the second engaged part 72*a* passes in a process in which the lock lever 70 moves from the unlock position to the lock position. In the example of the second connector C2, the interference part 25*a* is defined above the fitting hole 27. The interference part 25*a* and the engaging parts 27*a*, 26*a* are formed on each of the right and left sidewalls 25. In a process in which the lock lever 70 moves toward the lock position in the intermediate stop state, the right and left second engaged parts 72*a* interfere with the interference part 25*a* and move toward the fitting hole 27 while sliding on the inner surface of the interference part 25*a*. In this process, the second connector C2 is guided to the center in the horizontal direction (the direction along the axis line Ax).

The elastic part 72 and the second engaged part 72*a* rotate about the axis line Ax inside the frame 20. The length of the elastic part 72 and the position and shape of the second engaged part 72*a* may be formed so as not to interfere with the inner surface of the front wall 24 of the frame 20 in a process of rotation of the elastic part 72 and the second engaged part 72*a*. Specifically, the edge 72*d* (cf. FIG. 8) of the second engaged part 72*a* may be formed obliquely in order to avoid interference with the inner surface of the front wall 24.

As illustrated in FIG. 9A, in the intermediate stop state, a front part 73*b* of the first engaged part 73 is positioned in front of the axis line Ax of the lock lever 70. That is, the front part 73*b* of the first engaged part 73 is positioned in front of a vertical plane Pv passing through the axis line Ax and along the connection direction of the connectors C1, C2. On the other hand, as illustrated in FIG. 10A, in the locked state of the connectors C1, C2, the front part (lower part) 73*b* of the first engaged part 73 is positioned behind the axis line Ax. That is, the front part (lower part) 73*b* of the first engaged part 73 is positioned behind the vertical plane Pv passing through the axis line Ax and along the connection direction of the connectors C1, C2. With this structure, when the second connector C2 is pushed toward the first connector C1 in the intermediate stop state, a moment is generated in the lock lever 70, and the lock lever 70 can be prevented from rotating to the engagement region 26*f* without receiving the rotation operation by the operator.

As illustrated in FIG. 10A, in the locked state of the connectors C1, C2, the contact position between the first engaging part 26*a* and the first engaged part 73 and the contact position between the second engaging part 27*a* and the second engaged part 72*a* are positioned on opposite sides of the plane Pv passing through the axis line Ax and along the connection direction of the connectors C1, C2. Thus, when the force to separate the second connector C2 from the first connector C1 acts, a moment in the opposite direction is generated in the lock lever 70. That is, a clockwise moment is generated in the lock lever 70 due to the contact between the first engaging part 26*a* and the first engaged part 73. On the other hand, a counterclockwise moment is generated in the lock lever 70 due to the contact between the second engaging part 27*a* and the second engaged part 72*a*. Therefore, when the force to separate the second connector C2 from the first connector C1 acts, the lock lever 70 can be prevented from rotating toward the unlock position.

In FIG. 10A, a distance L3 is a distance from the contact position between the first engaging part 26*a* and the first engaged part 73 to the axis line Ax. A distance L4 is a distance from the contact position between the second engaging part 27*a* and the second engaged part 72*a* to the axis line Ax. More specifically, the distance L4 is a distance between a portion farthest from the axis line Ax in the first engaged part 73 and the axis line Ax. The distance L4 is larger than the distance L3. In this positional relationship, when the force to separate the second connector C2 from the first connector C1 acts, the moment caused by the contact between the second engaging part 27*a* and the second engaged part 72*a* becomes larger than the moment caused by the contact between the first engaging part 26*a* and the first engaged part 73. As a result, it is possible to more reliably prevent the lock lever 70 from rotating toward the unlock position.

As illustrated in FIG. 10A, the second engaged part 72*a* and the first engaged part 73 are positioned at different heights. In the locked state of the connectors C1, C2, the position of the second engaged part 72*a* is lower than the position of the first engaged part 73. More specifically, the position of the second engaged part 72*a* is lower than the lower end of the first engaged part 73. In this positional relationship, it is easy to make the above-described distance L4 larger than the distance L3 while preventing an increase in the size of the second connector C2 in the front-rear direction. Since the position of the second engaged part 72*a* is lower than the first engaged part 73, it is easy to ensure the length (the length in the connection direction of the connectors C1, C2) of the elastic part 72 of the lock lever 70 while preventing the increase in the size of the second connector C2 in the front-rear direction.

In the locked state of the connectors C1, C2, the rear end 27*c* of the second engaging part 27*a* is positioned behind the front edge 26*h* of the passage hole 26 through which the first engaged part 73 passes. It is thereby possible to prevent the increase in the size of the second connector C2 in the front-rear direction.

In FIG. 10A, a distance L5 is a distance to an operated part 74*a*, described later, formed in the lateral extension 74 of the lock lever 70. The distance L5 is further larger than the distance L4 described above. Hence, the operator can operate the lock lever 70 relatively easily. In the locked state of the connectors C1, C2, the operated part 74*a* is positioned above the front wall 24 of the frame 20. The operated part 74*a* may be positioned behind the front surface of the front wall 24, or the front surface of the operated part 74*a* and the front surface of the front wall 24 may be positioned on the same vertical plane. In this manner, it is possible to prevent the increase in the size of the connector assembly 1 in the front-rear direction.

As illustrated in FIG. 2, when the lock lever 70 is in the unlock position, the lateral extension 74 of the lock lever 70 may be disposed on the upper side of the second housing 60. The second housing 60 may have, on its upper surface, a support base 61*a* (cf. FIG. 1) that supports the lateral extension 74 of the lock lever 70 in the unlock position. Such placement of the lock lever 70 and the support base 61*a* is made possible by extending the cables 91, 92 from the rear side of the second connector C2 instead of extending from the upper side of the second connector C2. Further, defining the unlock position on the upper side of the second housing 60 has made it possible to sufficiently ensure the movable range of the lock lever 70. In the connector assembly 1, the movable range of the lock lever 70 is approximately 90 degrees.

The support base 61*a* is defined behind the axis line Ax, and when the lock lever 70 is at the unlock position, the lateral extension 74 is positioned behind the axis line Ax. On the other hand, when the lock lever 70 is at the lock position, the lateral extension 74 is positioned on the front side of the second housing 60 (cf. FIG. 1).

As illustrated in FIG. 2, a recessed fitting part 61*b* is formed on the support base 61*a*. On the other hand, the lateral extension 74 of the lock lever 70 may have an engaging part 74*b* as a hole into which the fitting part 61*b* is fitted when the lock lever 70 is at the unlock position. With this structure, it is possible to effectively prevent the vibration of the lock lever 70 at the unlock position in the horizontal direction. Contrary to the example of the connectors C1, C2, a recess may be formed in the support base 61*a*, and a protrusion functioning as the engaging part 74*b* may be formed in the lateral extension 74. As illustrated in FIG. 1, the lateral extension 74 may further have the operated part 74*a* at the center in the direction along the axis line Ax (horizontal direction). The operated part 74*a* protrudes from the edge of the lateral extension 74.

As illustrated in FIG. 8, a length L1 of the elastic part 72 is larger than a distance L2 from the axis line Ax to the elastic part 72. Here, the length L1 is a length of a portion that elastically deforms. The distance L2 is a distance from the axis line Ax to the edge of the elastic part 72. With this structure, the amount of elastic deformation of the elastic part 72 (the displacement of the second engaged part 72*a* in the horizontal direction) can be ensured sufficiently. As illustrated in FIG. 8, the side part 71 of the lock lever 70 has an attached part 71*a* fixed to the second housing 60 by the lever attaching part 62*c*. A slit S1 is formed between the attached part 71*a* and the elastic part 72. In the example of the first connector C1, the length of the slit S1 coincides with the length L1 of the elastic part 72.

As illustrated in FIG. 10A, when the lock lever 70 is at the lock position, the elastic part 72 extends in the connection direction of the connectors C1, C2 (a downward direction for the connector C2). With the lock lever 70 formed in this shape, it is possible to ensure the length of the elastic part 72 while reducing the size of the connectors C1, C2 in the direction intersecting both the connection direction of the connectors C1, C2 and the direction along the axis line Ax (the front-rear direction in the example of the connector assembly 1).

As illustrated in FIG. 10A, the second connector C2 holds the cables 91, 92 at the rear part (in the housing rear part 63). In the locked state of the connectors C1, C2, the position of the first engaged part 73 and the position of the second engaged part 72*a* are separated in the front-rear direction. More specifically, the first engaged part 73 is positioned behind the axis line Ax, and the second engaged part 72*a* is positioned in front of the axis line Ax. With such placement, for example, when a force that lifts the cables 91, 92 to incline the second connector C2 forward acts on the cables 91, 92, the first engaged part 73 and the first engaging part 26*a* can prevent the rear part of the second connector C2 from being lifted due to this force. On the other hand, when a force that lowers the cables 91, 92 to incline the second connector C2 rearward acts on the cables 91, 92, the second engaged part 72*a* and the second engaging part 27*a* can prevent the front part of the second connector C2 from being lifted due to this force.

As illustrated in FIG. 10A, in the locked state of the connectors C1, C2, both the first engaged part 73 and the housing rear part 63 holding the cables 91, 92 are positioned behind the second engaged part 72*a* and higher than the position of the second engaged part 72*a*. With this placement, the distance between the housing rear part 63 and the first engaged part 73 becomes short. As a result, it is possible to prevent the first connector C1 from being inclined forward or rearward when the cables 91, 92 are pulled upward.

In the example of the connector assembly 1, the first engaged part 73 is in contact with the first engaging part 26*a* in the locked state of the connectors C1, C2. The first engaged part 73 is bent in the horizontal direction and is in contact with the first engaging part 26*a* at a collision edge 73*a* (an edge oriented in a direction intersecting the horizontal direction, more specifically, an edge oriented obliquely upward). Therefore, the first engaged part 73 has higher rigidity than the second engaged part 72*a* against the force received by the first engaged part 73 and the second engaged part 72*a*. As a result, it is possible to more effectively prevent the first connector C1 from being inclined when the cables 91, 92 are pulled upward.

As illustrated in FIG. 10A, when the lock lever 70 is in the lock position, the position of the axis line Ax of the lock lever 70 is lower than that of an upper edge 25*d* (specifically, the upper surface of the guide part 25*b*) of the frame 20 in the connection direction of the connectors C1, C2 (an upward direction for the connector C1). Thereby, the movement (inclination) of the second connector C2 in the front-rear direction can be effectively prevented by the frame 20. In addition, since the engaged parts 73, 72*a* can be provided at positions separated downward from the upper edge 25*d* of the frame 20, the strength of a portion that regulates the upward movement of the engaged parts 73, 72*a* (a portion above the engaging parts 26*a*, 27*a* in the sidewall 25) can be easily ensured. In the example of the connectors C1, C2, the entire lever attaching part 62*c* is lower than the upper edge 25*d* of the frame 20.

As described above, the frame 20 has the lateral extension 23*a* (cf. FIG. 10B) extending along the rear side of the housing rear part 63 of the second housing 60 holding the cables 91, 92. The right and left sidewalls 25 are connected via the lateral extension 23*a*. The cables 91, 92 pass between an upper edge 23*f* of the lateral extension 23*a* and the lock lever 70 at the unlock position and extend obliquely rearward and upward from the housing rear part 63. In other words, the cables 91, 92 pass between the upper edge 23*f* of the lateral extension 23*a* and the support base 61*a* of the second housing 60 and extend obliquely rearward and upward from the housing rear part 63. With this structure, the arrangement density of the plurality of connector assemblies 1 in the front-rear direction can be increased, the rigidity of the frame 20 can be ensured by the lateral extension 23*a*, and the movable range of the lock lever 70 can be ensured.

As described above, the connector assembly 1 includes: the first connector C1 that includes the plurality of terminals 11, 12 arranged in the horizontal direction and the frame 20 surrounding the plurality of terminals 11, 12; and the second connector C2 that includes the plurality of terminals 51, 52 arranged in the horizontal direction, are connected to the first connector C1 in the vertical direction, and are disposed inside the frame 20. The second connector C2 includes the lock lever 70 that is movable between the lock position at which the second connector C2 engages with the frame 20 and the unlock position at which the second connector C2 disengages from the frame 20. The lock lever 70 has the first engaged part 73 and the second engaged part 72*a*. The frame 20 has the first engaging part 26*a* and the second engaging part 27*a*. The first engaging part 26*a* is engaged with the first engaged part 73 in the locked state where the lock lever 70 is at the lock position, and regulates the separation of the first connector C1 and the second connector C2 in the vertical direction. The lock lever 70 has the elastic part 72 that is elastically deformable in the horizontal direction. The elastic part 72 has the second engaged part 72*a* and is elastically deformed in the horizontal direction in the locked state to bring the second engaged part 72*a* into contact with the second engaging part 27*a*. According to the connector assembly 1, it is possible to prevent the relative positions of the two connectors C1, C2 from changing in the horizontal direction due to the slight vibration of the device mounted with the connector assembly 1.

Note that the connector assembly proposed in the present disclosure is not limited to the connector assembly 1 described so far.

In the connector assembly 1, the lock lever 70 is rotatable about the axis line Ax, and the position of the axis line Ax is fixed. The movement of the lock lever 70 is not limited thereto. For example, the rotation center of the lock lever 70 (the axis line Ax in the second connector C2) may be slidable in a direction orthogonal to the axis line Ax (e.g., forward or rearward) in the process of rotation of the lock lever 70. In still another example, the lock lever 70 may be movable in parallel in the vertical direction and/or the front-rear direction without rotating.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

The invention claimed is:

1. A connector assembly comprising:

a first connector including a plurality of terminals arranged in a first direction and a frame surrounding the plurality of terminals; and a second connector including a plurality of terminals arranged in the first direction and disposed inside the frame, wherein the second connector includes a lock lever movable between a lock position at which the second connector is engaged with the frame and an unlock position at which the second connector is disengaged from the frame, the lock lever has a first engaged part, an elastic part elastically deformable in the first direction, and a second engaged part formed in the elastic part, the frame has a first engaging part including a first hole formed through a sidewall of the frame of the first connector and a second engaging part including a second hole formed through the sidewall of the frame of the first connector, in a locked state where the lock lever is at the lock position, the first engaging part engages with the first engaged part to regulate separation of the first connector and the second connector in the second direction, and the elastic part elastically deforms in the first direction in the locked state.

2. The connector assembly according to claim 1, wherein one of the second engaged part and the second engaging part is a protrusion protruding in the first direction, and the other of the second engaged part and the second engaging part is positioned with respect to the protrusion in a direction from the lock position toward the unlock position and regulates movement of the protrusion in the direction from the lock position toward the unlock position.

3. The connector assembly according to claim 1, wherein one of the second engaged part and the second engaging part has an inclined surface, and the inclined surface is pressed against the other of the second engaged part and the second engaging part by an elastic force of the elastic part and generates a force that presses the second engaged part toward the lock position.

4. A connector assembly comprising:

a first connector including a plurality of terminals arranged in a first direction and a frame surrounding the plurality of terminals; and a second connector including a plurality of terminals arranged in the first direction, connected to the first connector in a second direction, and disposed inside the frame, wherein the second connector includes a lock lever movable between a lock position at which the second connector is engaged with the frame and an unlock position at which the second connector is disengaged from the frame, the lock lever has a first engaged part and a second engaged part on one a side of the second connector in the first direction, the frame has a first engaging part and a second engaging part on one a side of the first connector in the first direction, in a locked state where the lock lever is at the lock position, the first engaging part engages with the first engaged part to regulate separation of the first connector and the second connector in the second direction, one of the lock lever and the frame has an elastic part elastically deformable in the first direction, the elastic part has one of the second engaged part and the second engaging part and elastically deforms in the first direction in the locked state to bring the one into contact with the other of the second engaged part and the second engaging part, the frame has the first engaging part and the second engaging part on a side opposite to the one side of the first connector in the first direction, and the lock lever has the first engaged part and the second engaged part on a side opposite to the one side of the second connector in the first direction.

5. The connector assembly according to claim 1, wherein the elastic part is formed in the lock lever, the frame has an interference part, and in a process in which the lock lever moves from the unlock position toward the lock position, the interference part interferes with the second engaged part to press the lock lever in the first direction.

6. The connector assembly according to claim 1, wherein the lock lever is rotatable between the lock position and the unlock position about an axis line along the first direction.

7. The connector assembly according to claim 6, wherein a length of the elastic part is larger than a distance from the axis line to the elastic part.

8. The connector assembly according to claim 1, wherein one of the first engaged part and the first engaging part is a portion bent in the first direction, the one of the first engaged part and the first engaging part has an edge oriented in a direction intersecting the first direction, and the edge of the one of the first engaged part and the first engaging part is in contact with the other of the first engaged part and the first engaging part.

9. The connector assembly according to claim 6, wherein the first connector includes a stopper part with which the first engaged part of the lock lever at the unlock position collides in a process of connecting the first connector and the second connector, at least a part of the first engaged part in contact with the stopper part is positioned on one side in a direction intersecting both the second direction and the first direction, with respect to the axis line, and the at least part of the first engaged part engaged with the first engaging part is positioned on the other side in the direction intersecting both the second direction and the first direction with respect to the axis line.

10. The connector assembly according to claim 1, wherein in the locked state, one of the first engaged part and the second engaged part is separated from the other of the first engaged part and the second engaged part toward one side in a direction intersecting both the first direction and the second direction, the second connector includes a housing having a holding part that holds a cable connected to the second connector, and the holding part is positioned on the one side of the housing.

11. The connector assembly according to claim 10, wherein the cable extends from the second connector in a direction inclined with respect to the second direction, the lock lever has an extension extending in the first direction, and the extension is positioned in the second direction with respect to the second connector when the lock lever is at the unlock position.

12. The connector assembly according to claim 6, wherein in the locked state, a position of the axis line is lower than an upper edge of the frame in the second direction.

13. A connector assembly comprising:

a first connector including a plurality of terminals arranged in a first direction and a frame surrounding the plurality of terminals; and a second connector including a plurality of terminals arranged in the first direction, wherein the second connector includes a lock lever, the lock lever includes a first engaged part and a second engaged part, the frame of the first connector includes a hole formed through a sidewall of the frame of the first connector, and in a locked state where the lock lever is at a lock position, one of the first engaged part and the second engaged part engages with the hole to regulate separation of the first connector and the second connector.

14. The connector assembly according to claim 13, wherein in the locked state, the one of the first engaged part and the second engaged part engages with an edge of the hole to regulate separation of the first connector and the second connector.

15. The connector assembly according to claim 14, wherein another one of the first engaged part and the second engaged part is elastically deformable in the first direction.

16. The connector assembly according to claim 13, wherein the lock lever has an elastic part elastically deformable in the first direction, the second engaged part is formed in the elastic part, the frame of the first connector includes a second hole formed through the sidewall of the frame of the first connector, and in the locked state where the lock lever is at a lock position, another one of the first engaged part and the second engaged part engages with the second hole.

17. The connector assembly according to claim 16, wherein in the locked state, the another one of the first engaged part and the second engaged part engages with an edge of the second hole to regulate separation of the first connector and the second connector.

18. The connector assembly according to claim 13, wherein one of the first engaged part and the second engaged part has an inclined surface, and the inclined surface generates a force that presses the lock lever toward the lock position.

19. The connector assembly according to claim 13, wherein the lock lever is rotatable between the lock position and an unlock position about an axis line along the first direction.

20. The connector assembly according to claim 19, wherein the frame has an interference part, and in a process in which the lock lever moves from the unlock position toward the lock position, the interference part interferes with the second engaged part to press the lock lever in the first direction.

* * * * *